US009227406B2

(12) United States Patent
Wang et al.

(10) Patent No.: US 9,227,406 B2
(45) Date of Patent: Jan. 5, 2016

(54) METHOD OF MANUFACTURING AN EJECTION ORIFICE MEMBER

(71) Applicant: CANON KABUSHIKI KAISHA, Tokyo (JP)

(72) Inventors: Shinan Wang, Komae (JP); Yasuto Kodera, Fujisawa (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/453,061

(22) Filed: Aug. 6, 2014

(65) Prior Publication Data

US 2015/0060397 A1 Mar. 5, 2015

(30) Foreign Application Priority Data

Aug. 30, 2013 (JP) ..... 2013-179129

(51) Int. Cl.
*B41J 2/16* (2006.01)

(52) U.S. Cl.
CPC ..... *B41J 2/162* (2013.01); *B41J 2/1628* (2013.01); *B41J 2/1629* (2013.01); *B41J 2/1631* (2013.01); *B41J 2/1632* (2013.01); *B41J 2/1643* (2013.01); *B41J 2/1646* (2013.01)

(58) Field of Classification Search
None
See application file for complete search history.

(56) References Cited

U.S. PATENT DOCUMENTS

2005/0162482 A1 * 7/2005 Lim et al. ..... 347/63

FOREIGN PATENT DOCUMENTS

JP 2004-330636 A 11/2004

* cited by examiner

*Primary Examiner* — Allan Olsen
(74) *Attorney, Agent, or Firm* — Fitzpatrick, Cella, Harper & Scinto

(57) ABSTRACT

A method of manufacturing an ejection orifice member includes: preparing a substrate including a first layer, a second layer, and a third layer, the first layer protruding in a first direction crossing a principal surface of the substrate, the second and third layers being formed on the first direction side of the first layer, the preparing a substrate including forming the second layer to follow a contour of a first direction side surface of the first layer, and then forming the third layer on a surface of the second layer which protrudes on the first direction side; performing plating using the second layer as a seed to form a fourth layer on the first direction side of the second layer; removing the third layer from the fourth layer to form a hole as the ejection orifice in the fourth layer; and thinning the fourth layer at least around the hole.

6 Claims, 5 Drawing Sheets

METHOD OF MANUFACTURING AN EJECTION ORIFICE MEMBER

BACKGROUND OF THE INVENTION

1. Field of the Invention

The present invention relates to a method of manufacturing an ejection orifice member, which is a member for forming a liquid droplet ejection head such as an inkjet recording head, and which has an ejection orifice for ejecting a liquid droplet formed therein. It is to be noted that the term "ejection orifice" herein employed means an entire through hole passing through the ejection orifice member in a thickness direction, including an opening defined in a surface of the ejection orifice member as an end portion of the through hole.

2. Description of the Related Art

In an inkjet recording head, it is desired that a droplet of liquid such as ink be ejected with a small drive force. In order to reduce the drive force, it is effective to reduce fluid resistance through an ejection orifice of an ejection orifice member. One way to accomplish this is to reduce the length of the ejection orifice. However, if the entire ejection orifice member is thinned, strength of the ejection orifice member is reduced, and not only handling of the ejection orifice member becomes difficult but also the ejection orifice member becomes more liable to break. Another way to accomplish this is to taper the ejection orifice. However, if the ejection orifice includes only a tapered portion, from the viewpoint of the manufacturing method, it is difficult to control the accuracy of the diameter of the ejection orifice which is an opening of the ejection orifice on an ejection side. Further, from the viewpoint of usage, the ejection orifice portion is liable to be deformed and damaged.

Therefore, as a structure of an ejection orifice having a reduced fluid resistance and having accurately controlled dimensions, it is desired that one end side of the ejection orifice communicating to an ink flow path be tapered and the other end side thereof as an ink ejection side be in a short and straight shape.

As such a technology, in Japanese Patent Application Laid-Open No. 2004-330636, there is disclosed a method of manufacturing an ejection orifice member having an ejection orifice which includes a tapered portion and a straight portion. The manufacturing method includes forming the tapered portion of the ejection orifice by proximity exposure and plating and forming the straight portion of the ejection orifice by exposure and plating from a rear surface of a transparent substrate.

SUMMARY OF THE INVENTION

Accordingly, the present invention is directed to providing a method of manufacturing an ejection orifice member in view of the above-mentioned problem, and an object of the present invention is to manufacture with ease an ejection orifice member in which fluid resistance through an ejection orifice is reduced compared with the related art and a surface having the ejection orifice opened therein is flat to secure the strength as a whole.

According to one aspect of the present invention, there is provided a method of manufacturing an ejection orifice member including an ejection orifice for ejecting liquid, the method including:

preparing a substrate including a first layer, a second layer, and a third layer, the first layer protruding in a first direction crossing a principal surface of the substrate, the second layer and the third layer being formed on the first direction side of the first layer, the preparing a substrate including one of:

forming the second layer so as to follow a contour of a surface of the first layer on the first direction side, and then forming the third layer on a surface of the second layer which protrudes on the first direction side; and forming the third layer on the surface of the first layer which protrudes on the first direction side, and then forming the second layer on a surface of the third layer on the first direction side and on the surface of the first layer on the first direction side;

performing plating with the second layer being used as a seed to form a fourth layer on the first direction side of the second layer;

removing the third layer from the fourth layer to form a hole to be the ejection orifice in the fourth layer; and thinning the fourth layer at least around the hole.

According to another aspect of the present invention, there is provided a method of manufacturing an ejection orifice member on a principal surface of a flow path substrate, the ejection orifice member including an ejection orifice for ejecting liquid, the method including:

preparing the flow path substrate having a first opening of a flow path provided in the principal surface thereof;

forming a first layer on the principal surface so as to cover the first opening;

causing a portion of the first layer which covers the first opening to protrude in a first direction crossing the principal surface;

one of forming a second layer so as to follow a contour of a surface of the first layer on the first direction side and then forming a third layer on a surface of the second layer which protrudes on the first direction side, and forming the third layer on the surface of the first layer which protrudes on the first direction side and then forming the second layer on a surface of the third layer on the first direction side and on the surface of the first layer on the first direction side;

performing plating with the second layer being used as a seed to form a fourth layer on the first direction side of the second layer;

removing the third layer from the fourth layer to form a hole to be the ejection orifice in the fourth layer;

thinning the fourth layer at least around the hole; and removing a part of the second layer and a part of the first layer which correspond to the ejection orifice so that the ejection orifice and the flow path communicate to each other.

The ejection orifice member manufactured by using such a manufacturing method has a smallest thickness at the ejection orifice and a sufficient thickness at portions away from the ejection orifice toward a periphery thereof. Therefore, a straight portion of the ejection orifice can be shortened compared with the related art while strength of the ejection orifice member as a whole is secured, which enables drastic reduction in fluid resistance through the ejection orifice. Further, a surface of the manufactured ejection orifice member in which the ejection orifice opens is flat, and thus, a wiping unit configured to wipe and clean the surface is less liable to be damaged.

Further features of the present invention will become apparent from the following description of exemplary embodiments with reference to the attached drawings.

BRIEF DESCRIPTION OF THE DRAWINGS

FIGS. 2A, 2B, 2C, 2D, 2E, 2F, 2G, 2H, 2I, 2J, 2K-1, 2K-2, 2K-3 and 2K-4 illustrate a method of manufacturing an ejection orifice member according to a second embodiment of the present invention.

FIGS. 3A, 3B, 3C, 3D, 3E, 3F, 3G, 3H, 3I, 3J, 3K-1, 3K-2, 3K-3 and 3K-4 illustrate a method of manufacturing an ejection orifice member according to a third embodiment of the present invention.

FIGS. 4A, 4B, 4C, 4D, 4E, 4F, 4G, 4H, 4I, 4J-1, 4J-2, 4J-3 and 4J-4 illustrate a method of manufacturing an ejection orifice member according to a fourth embodiment of the present invention.

DESCRIPTION OF THE EMBODIMENTS

Embodiments of the present invention are now described with reference to the attached drawings. It is to be noted that like reference symbols are used to designate like components throughout the figures and description thereof is made only in brief to avoid redundancy.

First Embodiment

FIG. 1A to FIG. 1E-4 illustrate a method of manufacturing an ejection orifice member according to a first embodiment of the present invention. In these figures, a method of manufacturing an ejection orifice member having an ejection orifice which includes a tapered portion and a straight portion is illustrated. FIG. 1A to FIG. 1E-3 are sectional views of the ejection orifice member, and FIG. 1E-4 is a plan view of the ejection orifice member.

Figure 1A:
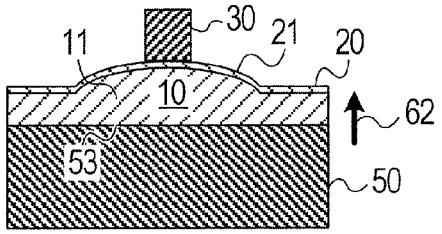
FIGS. 1A, 1B, 1C, 1D, 1E-1, 1E-2, 1E-3 and 1E-4 illustrate a method of manufacturing an ejection orifice member according to a first embodiment of the present invention.

First, as illustrated in FIG. 1A, a first layer 10, a second layer 20, and a third layer 30 are formed in this order on a principal surface 53 of a substrate 50. The first layer 10 has a protruding portion 11 which protrudes in a first direction 62 which crosses the principal surface 53. The second layer 20 has a curved portion 21 which curves following a contour of a surface of the protruding portion 11. It is to be noted that the first direction 62 is a direction corresponding to an ejection direction of a liquid droplet in a final form of the ejection orifice member, and the term "first direction" as herein employed is intended to mean the same direction.

The first layer 10 may be directly formed on the principal surface 53, or may be formed via an intermediate layer or an adhesive. A material of the first layer 10 is selected so that the protruding portion 11 may be formed with ease. For example, the first layer 10 itself may be deformed to form the protruding portion 11. In this case, it is desired that the first layer 10 be a flexible film. To be "flexible" as herein employed is to be deformable by an external force and a shape after the deformation is easy to maintain. Exemplary applicable materials include a metal, a resin (in particular, a thermosetting resin or a photosetting resin), and rubber. It is preferred that the first layer 10 have a thickness of, for example, 40 μm.

It is preferred that the protruding portion 11 be formed at any one timing before or after the formation of the first layer 10 on the substrate 50. When the protruding portion 11 is formed before the first layer 10 is formed on the substrate 50, the protruding portion 11 may be prepared by, for example, molding. In this case, a gap may be generated between the protruding portion 11 and the principal surface 53 of the substrate 50. On the other hand, when the protruding portion 11 is formed after the first layer 10 is formed on the substrate 50, by forming the first layer 10 after a protruding structure (not shown) is provided in advance on the principal surface 53 of the substrate 50, the protruding portion 11 may be formed in the first layer 10 so as to follow a contour of the protruding structure. Further, after the first layer 10 is formed on the principal surface 53 of the flat substrate 50, the protruding portion 11 may be formed by subjecting a surface of the first layer 10 to deposition, etching, or the like. When the deposition is used, a material of the protruding portion 11 may be different from a material of the first layer 10. A shape and dimensions of the protruding portion 11 may be designed in accordance with a shape and dimensions of the ejection orifice to be formed. Taking into consideration ejection performance of the ejection orifice, it is desired that the shape of the protruding portion 11 be symmetrical with respect to a center point thereof. For example, the protruding portion 11 is in the shape of a segment of a circle in section. Exemplary dimensions of the protruding portion 11 include a height of the segment of the circle of 20 μm and a radius of curvature thereof of 50 μm.

The second layer 20 is formed on an upper surface of the first layer 10. In this case, a protruding portion is formed in the second layer 20 so as to follow a contour of a curved surface of the protruding portion 11 of the first layer 10. The second layer 20 functions as a seed layer in the subsequent plating step, and thus, a material and thickness thereof may be selected in accordance with the plating step. For example, it is preferred that the second layer 20 be formed of a metal. The second layer 20 may be formed of metals of a plurality of layers. For example, as the second layer 20, a Cr film of 10 nm and a Pd film of 40 nm may be formed in this order on the upper surface of the first layer 10.

The third layer 30 is a pattern for defining the straight portion of the ejection orifice. The pattern of the third layer 30 is formed so that a center thereof may approximately match with a center of the protruding portion 11, and a shape and dimensions of the third layer 30 are designed in accordance with the shape and dimensions of the ejection orifice. For example, the pattern of the third layer 30 is cylindrical, and exemplary dimensions thereof include a diameter of 10 μm and a thickness of 30 μm. It is preferred that the third layer 30 be formed of a photoresist so that the pattern may be formed with ease.

In FIG. 1A, the third layer 30 is formed on the second layer 20, but the third layer 30 may be formed first on the first layer 10, and then the second layer 20 may be formed.

Figure 1B:
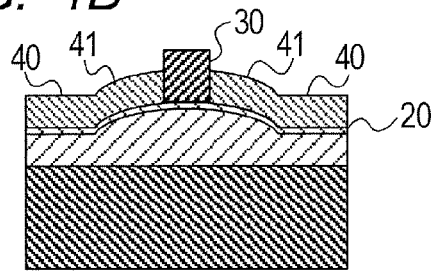

Next, as illustrated in FIG. 1B, plating is performed with the second layer 20 being used as a seed to form a fourth layer 40 on a surface of the second layer. It is suitable that the fourth layer 40 be formed of a metal such as Ni. Exemplary materials used for the fourth layer include, other than nickel, metal materials which can be grown by electroplating such as gold, copper, tin, zinc, cobalt, platinum, silver, and lead, and alloys thereof. In this embodiment, it is preferred that the fourth layer have a thickness of, for example, 25 μm. As a method of the plating, electroplating or electroless plating may be applied. The plating step can form a protruding portion 41 in the fourth layer 40 so as to follow a contour of the protruding portion 21 in the second layer 20.

Figure 1C:
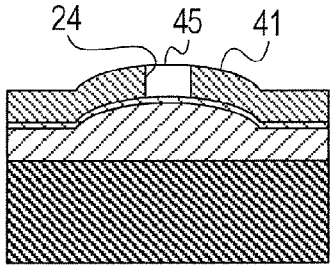

Then, as illustrated in FIG. 1C, the third layer 30 is removed and a hole 24 to be an ejection orifice 45 is formed in the fourth layer 40. The ejection orifice 45 is formed at a center of the protruding portion 41. When the third layer 30 is a photoresist, as a method of the removal, wet etching using an organic solvent, a resist remover, or the like, or dry etching using oxygen plasma or the like may be applied.

Figure 1D:
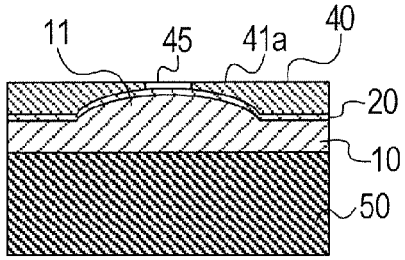

Next, at least the protruding portion 41 in the fourth layer 40 (a portion which is bowed outward and which has the ejection orifice 45 and the hole 24 at the center thereof) is thinned as illustrated in FIG. 1D. A portion denoted as 41*a* is the thinned portion. A suitable method of preferentially thinning the protruding portion 41 of the fourth layer is, for example, polishing. In order to enhance accuracy of a length of the straight portion of the ejection orifice and flatness and smoothness of a surface of the ejection orifice member, various kinds of improvements are made including use of a lower polishing rate and finer abrasive grains in final polishing. As necessary, chemical mechanical polishing (CMP) is used in the final polishing.

Then, as illustrated in FIG. 1E-1 to FIG. 1E-3, the fourth layer 40 is separated at least from the substrate 50 to complete a desired ejection orifice member. It is to be noted that the separation is made in different ways in accordance with the final forms of the ejection orifice member illustrated in FIG. 1E-1 to FIG. 1E-3, respectively.

Figures 1, 1E:
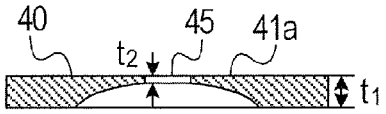

For example, in order to obtain an ejection orifice member as illustrated in FIG. 1E-1, the fourth layer 40 is peeled from the second layer 20. In this case, the second layer 20 may be selectively removed by wet etching. Alternatively, after the first layer 10 is removed, the second layer 20 may be selectively removed. The ejection orifice obtained in this way has a straight shape on an ink ejection side and has a tapered shape on an ink introduction side. Specifically, the straight portion of the ejection orifice is a hole portion formed by removing the third layer 30 from the fourth layer 40, and the tapered portion of the ejection orifice is a recessed portion formed in the fourth layer 40 by the protruding portion 21. The ejection orifice member formed in this way has a smallest thickness at the ejection orifice (thickness=$t_2$), gradually larger thicknesses from the ejection orifice 45 toward a periphery thereof, and a largest thickness at a flat portion outside the portion 41*a* formed by thinning the protruding portion 41 (thickness=$t_1$). Exemplary thicknesses include $t_1$=25 μm and $t_2$=5 μm.

Figures 1, 1E, 2:
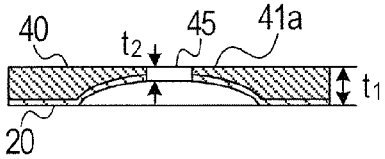

In order to obtain an ejection orifice member as illustrated in FIG. 1E-2, the fourth layer 40 and the second layer 20 are peeled together from the first layer 10. In this case, a part of the second layer 20 under the straight portion 45 of the ejection orifice is removed before or after the peeling. As a method of the partial removal, dry etching may be applied. For example, plasma etching with the fourth layer 40 being used as a mask is suitable. The partially removing step may be performed after the step of removing the third layer 30 illustrated in FIG. 1C, and before the step of polishing the fourth layer 40 illustrated in FIG. 1D. The ejection orifice obtained in this way has a straight shape on the ink ejection side and has a tapered shape on the ink introduction side. Specifically, the straight portion of the ejection orifice is a hole portion formed by removing the third layer 30 from the fourth layer 40 and removing the part of the second layer 20 opposed to the ejection orifice 45, and the tapered portion of the ejection orifice is a recessed portion formed below the second layer 20 by the protruding portion 11. The ejection orifice member formed in this way has the smallest thickness at the ejection orifice 45 (thickness=$t_2$), gradually larger thicknesses from the ejection orifice 45 toward a periphery thereof, and the largest thickness at the flat portion outside the portion 41*a* formed by thinning the protruding portion 41 (thickness=$t_1$). Exemplary thicknesses include $t_1$=25 μm and $t_2$=5 μm. It is to be noted that in the ejection orifice member as illustrated in FIG. 1E-2, each of the thickness $t_1$ and the thickness $t_2$ is a thickness which is the total of thicknesses of the second layer 20 and the fourth layer 40.

In order to obtain an ejection orifice member as illustrated in FIG. 1E-3, the fourth layer 40, the second layer 20, and the first layer 10 are peeled together from the substrate 50. In this case, the part of the second layer 20 under the straight portion 45 of the ejection orifice is removed, and further, a hole 15 is formed in a part of the first layer 10 below the removed part. A suitable method of forming the hole 15 is dry etching, for example, plasma etching with the fourth layer 40 being used as a mask. In particular, in order to form the hole 15 having a tapered shape as illustrated in FIG. 1E-3, isotropic plasma etching is suitable. The ejection orifice obtained in this way has a straight shape on the ink ejection side and has a tapered shape on the ink introduction side. Specifically, the straight portion of the ejection orifice is a hole portion formed by removing the third layer 30 from the fourth layer 40 and removing the part of the second layer 20 opposed to the ejection orifice 45, and the tapered portion of the ejection orifice is the hole 15 having a tapered shape formed in the first layer 10. The ejection orifice member formed in this way has the smallest thickness at the ejection orifice 45 (thickness=$t_2$), gradually larger thicknesses from the ejection orifice 45 toward a periphery thereof, and the largest thickness at the flat portion outside the portion 41*a* formed by thinning the protruding portion 41 (thickness=$t_1$). Exemplary thicknesses include $t_1$=65 μm and $t_2$=5 μm. It is to be noted that in the ejection orifice member as illustrated in FIG. 1E-3, the thickness $t_1$ is a thickness which is the total of the thicknesses of the first layer 10, the second layer 20, and the fourth layer 40, and the thickness $t_2$ is a thickness which is the total of the thicknesses of the second layer 20 and the fourth layer 40.

By the method described above, both an ejection orifice member 100 having only one ejection orifice and an ejection orifice member 100 having a plurality of ejection orifices as illustrated in a plan view of FIG. 1E-4 can be manufactured.

According to this embodiment, an ejection orifice member having a smallest thickness at the ejection orifice 45 and a sufficient thickness at portions away from the ejection orifice 45 toward a periphery thereof can be manufactured with ease. In such an ejection orifice member, compared with the related art, the fluid resistance through the ejection orifice is reduced, and at the same time, the strength of the ejection orifice member as a whole is secured. Further, an opened edge of the straight portion 45 of the ejection orifice is not burred in the ejection direction, and a surface of the ejection orifice member 100 in which the ejection orifice opens is flat. Thus, a wiping unit configured to wipe and clean the surface is less liable to be damaged.

Second Embodiment

FIGS. 2A to 2K-4 illustrate a method of manufacturing an ejection orifice member according to a second embodiment of the present invention. In these figures, a method of manufacturing an ejection orifice member having an ejection orifice which includes a tapered portion and a straight portion by using a through hole of a substrate is illustrated. FIG. 2A to FIG. 2K-3 are sectional views of steps of manufacturing the ejection orifice member, and FIG. 2K-4 is a plan view of an example of the ejection orifice member.

Figure 2A:
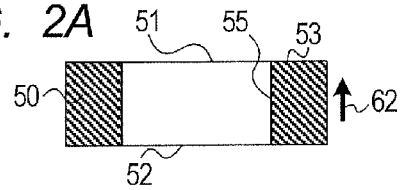

First, as illustrated in FIG. 2A, the substrate 50 having a through hole 55 formed therein is prepared. A material and a shape of the substrate 50 are selected so as to be suitable for subsequent steps. The through hole 55 has a first opening 51 formed in the principal surface 53 of the substrate 50 and a second opening 52 formed in a surface of the substrate 50 opposite to the principal surface 53. A shape and dimensions of the first opening 51 are designed in accordance with the ejection orifice to be formed. It is desired that a shape of the first opening 51 is symmetrical with respect to a center point thereof. In FIG. 2A, for the sake of easy understanding of this embodiment, the through hole 55 is illustrated so as to vertically pass through the substrate 50. However, this is not indispensable for the method of manufacturing an ejection orifice member according to the present invention. It is enough that the first opening 51 and the second opening 52 communicate to each other. A path between the two openings may be bent on the way, and any shape in section thereof does not present a problem in manufacture.

A method of forming the through hole 55 is selected in accordance with the material of the substrate 50 and a shape of the through hole 55. Exemplary substrate materials include a resin, a metal, glass, and Si. Exemplary methods of forming the through hole 55 include molding, electrical discharge machining, laser machining, dry machining using plasma etching, and wet etching using chemical liquid. Further, the substrate 50 having the through hole 55 formed therein may also be formed by processing and laminating a plurality of layers of materials. As an example, it is preferred that the substrate 50 be an Si substrate at a thickness of 0.5 mm and the first opening 51 of the through hole 55 be circular having a diameter of 150 μm.

Figure 2B:
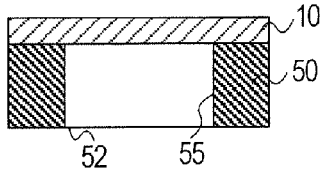

Then, as illustrated in FIG. 2B, the first layer 10 is formed on the principal surface 53 of the substrate 50 so as to cover the first opening 51. The first layer 10 may be directly formed on the principal surface 53, or may be formed via an intermediate layer or an adhesive. The material and the thickness of the first layer 10 may be determined so that a desired protruding portion 11 may be formed in the subsequent step. It is desired that the first layer 10 be a flexible film. Other exemplary materials suitable for the first layer 10 include a metal, a resin (in particular, a thermosetting resin or a photosetting resin), and rubber. For example, the first layer 10 may be formed of an adherent film-like photoresist. With regard to a kind of the photoresist, in particular, SU-8 and TMMF are suitable. When the first layer 10 is formed of a film-like photoresist, the first layer 10 may be bonded onto the principal surface 53 of the substrate 50 by lamination. As an example, the first layer 10 is formed of film-like SU-8, and it is preferred that the first layer 10 have a thickness of 30 μm.

Figure 2C:
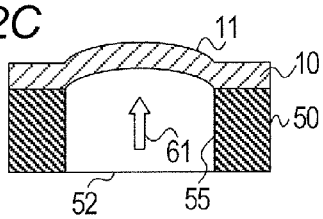

Then, as illustrated in FIG. 2C, the protruding portion 11 is formed in the first layer 10 under a state in which the portion of the first layer 10 which covers the first opening 51 protrudes in the first direction 62. A case in which the first layer 10 is a film-like photoresist of SU-8 is described in the following as an example. First, compressed air is fed from the second opening 52 of the through hole 55 into a recess-shaped space formed by a side wall of the through hole 55 and the first layer 10 (see a direction denoted as 61), and the pressure pressurizes the first layer 10 to form a shape of the protruding portion 11. With the state being maintained, the photoresist of SU-8 as the first layer 10 is exposed to ultraviolet radiation. Then, by heating up to about 180° C., the photoresist of SU-8 is cured to fix the protruding shape of the protruding portion 11. Pressure of air which is fed into the recess-shaped space is adjusted as necessary during the exposure and the heating so that the protruding portion 11 may be formed into a desired shape in the end. As an example of the desired shape of the protruding portion 11, it is preferred that the protruding portion 11 be a spherical crown, with the first opening 51 being a bottom surface thereof having a diameter of 150 μm and a radius of curvature at the top thereof being 150 μm.

Figure 2D:
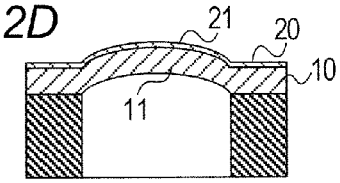

Then, as illustrated in FIG. 2D, the second layer 20 is formed on an upper surface of the first layer 10. In this case, the protruding portion 21 is formed in the second layer 20 so as to follow a contour of a curved surface of the protruding portion 11 of the first layer 10. The second layer 20 functions as a seed layer in the subsequent plating step, and thus, a material and thickness thereof may be selected in accordance with the plating step. For example, it is preferred that the second layer 20 be formed of a metal. The second layer 20 may be formed of metals of a plurality of layers. As an example of the second layer 20, by laminating a Cr film of 10 nm and a Pd film of 40 nm in this order onto the upper surface of the first layer 10 by sputtering, the second layer 20 can be formed.

Figure 2E:
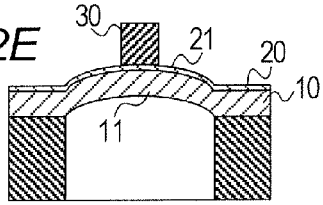

Then, as illustrated in FIG. 2E, the third layer 30 is formed on an upper surface of the second layer 20. The third layer 30 is a pattern for defining the straight portion of the ejection orifice. The pattern of the third layer 30 is formed so that the center thereof may approximately match with the center of the protruding portion 11, and the shape and dimensions thereof are designed in accordance with the shape and dimensions of the ejection orifice. As an example, the third layer 30 is formed of a pattern of a cylindrical photoresist, and it is preferred that the diameter be 10 μm and the thickness be 30 μm.

Figure 2F:
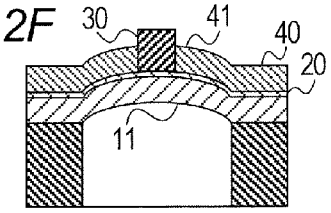

Next, as illustrated in FIG. 2F, plating is performed with the second layer 20 being used as a seed to form the fourth layer 40 on a surface of the second layer 20. As an example, the fourth layer 40 is formed of Ni which is formed by electroless plating on the second layer 20, and it is preferred that the thickness be 25 μm. In this step, the protruding portion 41 is formed in the fourth layer 40 so as to follow a contour of a curved surface of the protruding portion 21 of the second layer 20.

Figure 2G:
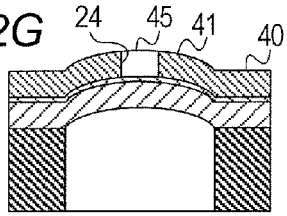

Then, as illustrated in FIG. 2G, the third layer is removed to form the hole 24 to be the straight portion 45 of the ejection orifice in the fourth layer 40. The straight portion 45 of the ejection orifice is formed at the center of the protruding portion 41. As an example, the third layer 30 is formed of a photoresist and is removed by a resist remover.

Figure 2H:
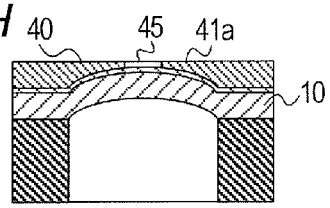

Next, at least the protruding portion 41 in the fourth layer 40 (a portion which is bowed outward and which has the straight portion 45 of the ejection orifice and the hole 24 at the center thereof) is thinned as illustrated in FIG. 2H. A portion denoted as 41*a* is the thinned portion. As an example, the fourth layer 40 is polished from an upper surface thereof so that the thickness of the ejection orifice member around the straight portion 45 of the ejection orifice may be 5 μm. This enables Ni as the fourth layer 40 to have a thickness of 5 μm around the straight portion 45 of the ejection orifice, gradually larger thicknesses from the straight portion 45 of the ejection orifice toward a periphery thereof, and a largest thickness at a flat portion outside the portion 41*a* formed by thinning the protruding portion 41 (about 25 μm).

Then, as illustrated in FIG. 2K-1 to FIG. 2K-3, the fourth layer 40 is separated at least from the substrate 50 to complete a desired ejection orifice member. It is to be noted that the separation is made in different ways in accordance with the final forms of the ejection orifice member illustrated in FIG. 2K-1 to FIG. 2K-3, respectively.

Figure 2I:
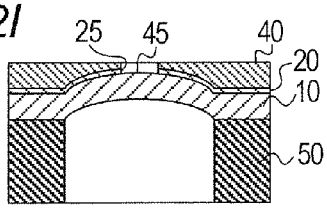
Figure 2J:
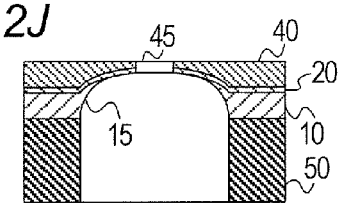
Figures 1, 2K:
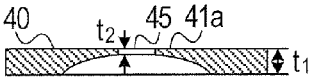
Figures 2, 2K:
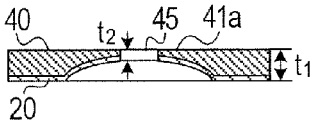
Figures 2, 2K, 3:
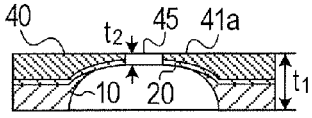
Figures 2, 2K, 3, 4:
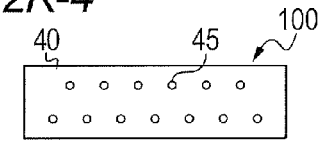

For example, in order to obtain an ejection orifice member as illustrated in FIG. 2K-1, the fourth layer 40 is peeled from the second layer 20. The ejection orifice obtained in this way has a straight shape on the ink ejection side and has a tapered shape on the ink introduction side. Specifically, the straight portion of the ejection orifice is a hole portion formed by removing the third layer 30 from the fourth layer 40, and the tapered portion of the ejection orifice is a recessed portion formed in the fourth layer 40 by the protruding portion 21. The ejection orifice member formed in this way has a smallest thickness at the ejection orifice 45 (thickness=$t_2$), gradually larger thicknesses from the ejection orifice 45 toward a periphery thereof, and a largest thickness at a flat portion outside the portion 41*a* formed by thinning the protruding portion 41 (thickness=$t_1$). Exemplary thicknesses include $t_1$=25 μm and $t_2$=5 μm.

In order to obtain an ejection orifice member as illustrated in FIG. 2K-2, the fourth layer 40 and the second layer 20 are peeled together from the first layer 10. In this case, a part of the second layer 20 under the straight portion 45 of the ejection orifice is removed to form a hole 25 before or after the peeling as illustrated in FIG. 2I. As an example of a method of the partial removal, argon ion milling may be applied before peeling the fourth layer 40 together with the second layer 20 from the first layer 10 with the fourth layer 40 being used as a mask. The partially removing step may be performed after the step of removing the third layer 30 illustrated in FIG. 2G, and before the step of polishing the fourth layer 40 illustrated in FIG. 2H. The ejection orifice obtained in this way has a straight shape on the ink ejection side and has a tapered shape on the ink introduction side. Specifically, the straight portion of the ejection orifice is a hole portion formed by removing the third layer 30 from the fourth layer 40 and removing the part of the second layer 20 opposed to the ejection orifice 45, and the tapered portion of the ejection orifice is a recessed portion formed below the second layer 20 by the protruding portion 11. The ejection orifice member formed in this way has the smallest thickness at the ejection orifice 45 (thickness=$t_2$), gradually larger thicknesses from the ejection orifice 45 toward a periphery thereof, and the largest thickness at the flat portion outside the portion 41*a* formed by thinning the protruding portion 41 (thickness=$t_1$). Exemplary thicknesses include $t_1$=25 μm and $t_2$=5 μm. It is to be noted that in the ejection orifice member as illustrated in FIG. 2K-2, each of the thickness $t_1$ and the thickness $t_2$ is a thickness which is the total of the thicknesses of the second layer 20 and the fourth layer 40.

Figures 1, 1E, 2, 3:
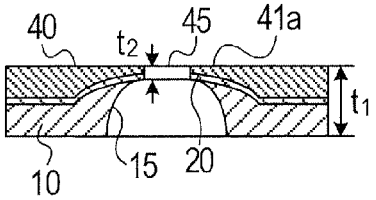

In order to obtain an ejection orifice member as illustrated in FIG. 2K-3, the fourth layer 40, the second layer 20, and the first layer 10 are peeled together from the substrate 50. Before the peeling, first, a part of the second layer 20 under the straight portion 45 of the ejection orifice is removed to form the hole 25 as illustrated in FIG. 2I. Then, as illustrated in FIG. 2J, the hole 15 is formed in a part of the first layer 10 below the removed part. As an exemplary method of forming the hole 15, oxygen plasma etching with the fourth layer 40 being used as a mask is suitable. In this way, the portion of the first layer 10 exposed in the hole 25 in the second layer 20 is isotropically etched by oxygen plasma to form the tapered hole 15. Finally, the fourth layer 40, the second layer 20, and the first layer 10 are together peeled from the substrate 50. The ejection orifice obtained in this way has a straight shape on the ink ejection side and has a tapered shape on the ink introduction side. Specifically, the straight portion of the ejection orifice is a hole portion formed by removing the third layer 30 from the fourth layer 40 and removing the part of the second layer 20 opposed to the ejection orifice 45, and the tapered portion of the ejection orifice is the hole 15 having a tapered shape formed in the first layer 10. The ejection orifice member formed in this way has the smallest thickness at the ejection orifice 45 (thickness=$t_2$), gradually larger thicknesses from the ejection orifice 45 toward a periphery thereof, and the largest thickness at the flat portion outside the portion 41*a* formed by thinning the protruding portion 41 (thickness=$t_1$). Exemplary thicknesses include $t_1$=65 μm and $t_2$=5 μm. It is to be noted that in the ejection orifice member as illustrated in FIG. 2K-3, the thickness $t_1$ is a thickness which is the total of the thicknesses of the first layer 10, the second layer 20, and the fourth layer 40, and the thickness $t_2$ is a thickness which is the total of the thicknesses of the second layer 20 and the fourth layer 40.

By the method described above, both the ejection orifice member 100 having only one ejection orifice and the ejection orifice member 100 having the plurality of ejection orifices as illustrated in a plan view of FIG. 2K-4 can be manufactured.

According to this embodiment, an ejection orifice member having a smallest thickness at the ejection orifice and a sufficient thickness at portions away from the ejection orifice 45 toward a periphery thereof can be manufactured with ease. In such an ejection orifice member, compared with the related art, the fluid resistance through the ejection orifice is reduced, and at the same time, the strength of the ejection orifice member as a whole is secured. Further, an opened edge of the straight portion 45 of the ejection orifice is not burred in the ejection direction, and a surface of the ejection orifice member 100 in which the ejection orifice opens is flat. Thus, a wiping unit configured to wipe and clean the surface is less liable to be damaged.

Third Embodiment

Figures 1, 1E, 2, 3, 4:
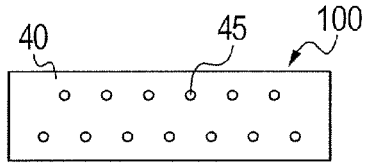
Figure 3A:
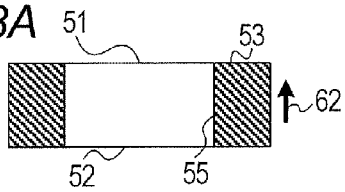
Figure 3B:
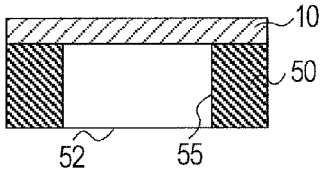
Figure 3C:
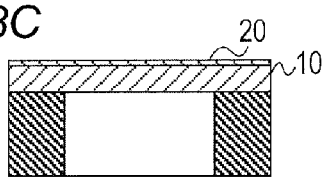
Figure 3D:
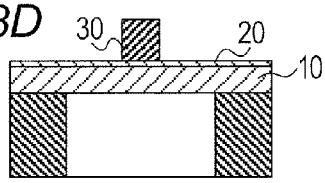
Figure 3E:
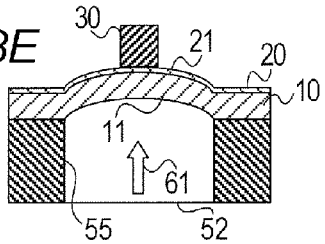
Figure 3F:
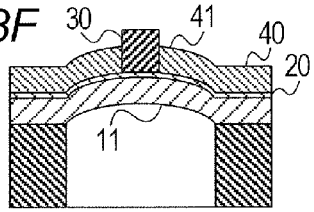
Figure 3G:
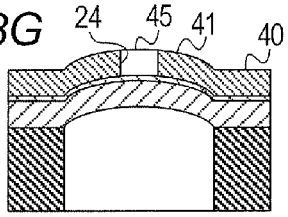
Figure 3H:
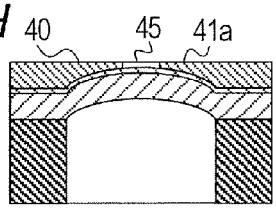
Figure 3I:
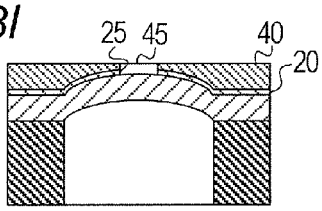
Figure 3J:
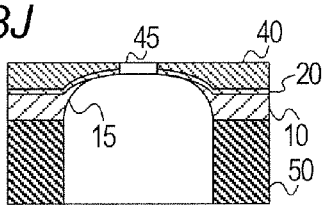
Figures 1, 3K:
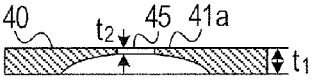
Figures 2, 3K:
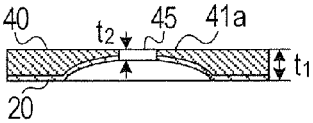
Figures 3, 3K:
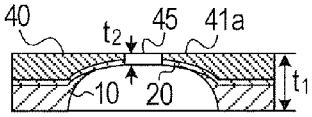
Figures 3, 3K, 4:
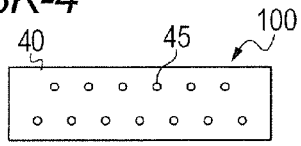

FIGS. 3A to 3K-4 illustrate a method of manufacturing an ejection orifice member according to a third embodiment of the present invention. In these figures, a method of manufacturing an ejection orifice member having an ejection orifice which includes a tapered portion and a straight portion by using a through hole of a substrate is illustrated. FIG. 3A to FIG. 3K-3 are sectional views of steps of manufacturing the ejection orifice member, and FIG. 3K-4 is a plan view of an example of the ejection orifice member.

In this embodiment, the order of forming the protruding portion 11 and forming the second layer 20 and the third layer 30 is reversed from that in the second embodiment. Other steps may be performed almost similarly to those in the second embodiment, and thus, detailed description thereof is omitted. In the following, points different from those in the second embodiment are mainly described.

First, as illustrated in FIG. 3A, the substrate 50 having the through hole 55 formed therein is prepared.

Then, as illustrated in FIG. 3B, the first layer 10 is formed on the principal surface 53 of the substrate 50 so as to cover the first opening 51. As an example, it is preferred that the first layer 10 be a film-like thermosetting resin. In this case, the first layer 10 is bonded onto the principal surface 53 of the substrate 50 by lamination. It is preferred that the thickness be, for example, 30 μm.

Then, as illustrated in FIG. 3C, the second layer 20 is formed on the upper surface of the first layer 10. As an example, by laminating a Cr film of 10 nm and a Pd film of 40 nm in this order onto the upper surface of the first layer 10 by sputtering, the second layer 20 can be formed.

Then, as illustrated in FIG. 3D, the third layer 30 is formed on the upper surface of the second layer 20. As an example, the third layer 30 is formed of a pattern of a cylindrical photoresist, and it is preferred that the diameter be 10 μm and the thickness be 30 μm.

Then, as illustrated in FIG. 3E, the protruding portion 11 is formed in the first layer 10 under a state in which the portion of the first layer 10 which covers the first opening 51 protrudes in the first direction 62. As an example, first, compressed air is fed from the second opening 52 of the through hole 55 into a recess-shaped space formed by a side wall of the through hole 55 and the first layer 10 (see the direction denoted as 61), and the pressure forms a shape of the protruding portion 11. With the state being maintained, the thermosetting resin as the first layer 10 is heated and curved to fix the protruding shape of the protruding portion 11. Pressure of air which is fed into the recess-shaped space is adjusted as necessary during the heating so that the protruding portion 11 may be formed into a desired shape in the end. As an example of the desired shape of the protruding portion 11, it is preferred that the protruding portion 11 be a spherical crown, with the first opening 51 being a bottom surface thereof having a diameter of 150 μm and a radius of curvature at the top thereof being 150 μm.

Subsequently, as illustrated in FIG. 3F to FIG. 3K-4, steps similar to the steps illustrated in FIG. 2F to FIG. 2K-4 of the second embodiment described above are performed to manufacture the desired ejection orifice member 100.

Fourth Embodiment

Figure 4A:
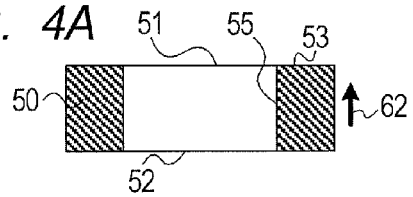
Figure 4B:
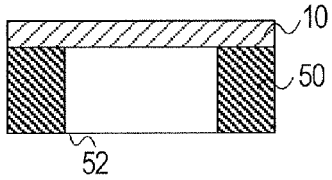
Figure 4C:
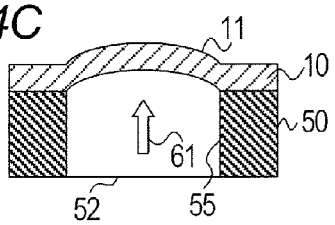
Figure 4D:
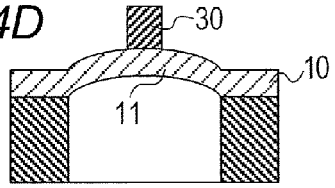
Figure 4E:
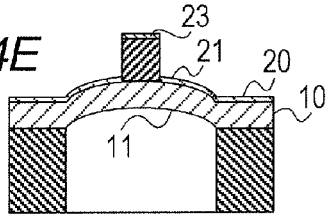
Figure 4F:
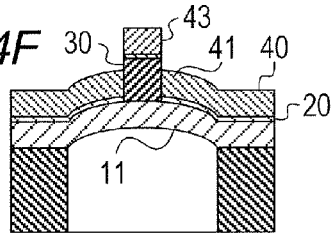
Figure 4G:
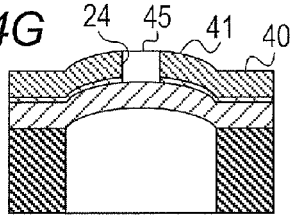
Figure 4H:
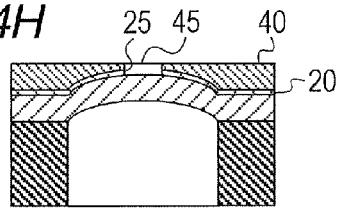
Figure 4I:
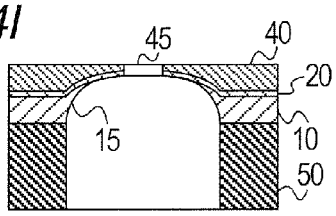
Figures 1, 4J:
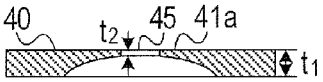
Figures 2, 4J:
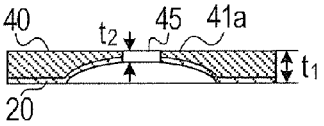
Figures 3, 4J:
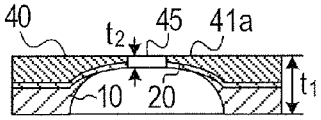
Figures 4, 4J:
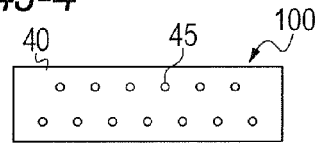

FIGS. 4A to 4J-4 illustrate a method of manufacturing an ejection orifice member according to a fourth embodiment of the present invention. In these figures, a method of manufacturing an ejection orifice member having an ejection orifice which includes a tapered portion and a straight portion by using a through hole of a substrate is illustrated. FIG. 4A to FIG. 4J-3 are sectional views of steps of manufacturing the ejection orifice member, and FIG. 4J-4 is a plan view of an example of the ejection orifice member.

In this embodiment, the order of forming the second layer 20 and forming the third layer 30 is reversed from that in the second embodiment. Other steps may be performed almost similarly to those in the second embodiment, and thus, detailed description thereof is omitted. In the following, points different from those in the second embodiment are mainly described.

First, as illustrated in FIG. 4A to FIG. 4C, steps similar to those in the second embodiment are performed.

Then, as illustrated in FIG. 4D, the third layer 30 is formed on the upper surface of the first layer 10.

Then, as illustrated in FIG. 4E, the second layer 20 is formed on the upper surface of the first layer 10 and on an upper surface of the third layer 30. As a method of forming the second layer 20, metal sputtering, vacuum deposition, and the like are suitable. In this case, the second layer 20 is formed on the upper surface of the first layer 10, and in addition, a film 23 of the second layer 20 is formed on the pattern of the third layer 30.

Then, as illustrated in FIG. 4F, plating is performed with the second layer 20 being used as a seed to form the fourth layer 40 on the surface of the second layer 20. In this case, plating 43 may be formed above the pattern of the third layer 30 with the film 23 being used as a seed.

Then, as illustrated in FIG. 4G, the third layer is removed to form the hole 24 to be the straight portion 45 of the ejection orifice in the fourth layer 40. The straight portion 45 of the ejection orifice is formed at the center of the protruding portion 41. In this case, the plating 43 is removed together with the third layer 30. Even if the plating 43 cannot be completely removed in this step, the plating 43 can be completely removed in the subsequent step (polishing step illustrated in FIG. 4H).

Subsequently, as illustrated in FIG. 4H to FIG. 4J-4, steps similar to steps illustrated in FIG. 2H to FIG. 2K-4 of the second embodiment described above are performed to manufacture the desired ejection orifice member 100. However, in this embodiment, as illustrated in FIG. 4E to FIG. 4H, the second layer 20 does not exist under the straight portion 45 of the ejection orifice, and thus, the step of partially removing the second layer 20 of the second embodiment illustrated in FIG. 2I is not necessary.

It is to be noted that the orifice plate proposed in any one of the first to fourth embodiments described above may be joined to a substrate in which one or a plurality of flow paths for supplying liquid to one or a plurality of ejection orifices in the ejection orifice member are formed (referred to as flow path substrate). In this case, by providing, to the flow path substrate, a unit configured to generate ejection energy for ejecting the liquid through the ejection orifice, a liquid ejection head such as an inkjet head can be formed. Exemplary units configured to generate the ejection energy include a heat-generating resistor (for example, a heater) and a piezoelectric substance (for example, PZT). Further, the liquid supplied to the flow path and the ejection orifice is not limited to liquid for recording such as ink, and may be chemical liquid for medical use, processing liquid for manufacturing, or the like.

Fifth Embodiment

Figure 5A:
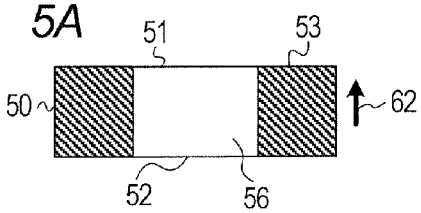
FIGS. 5A, 5B, 5C, 5D, 5E, 5F, 5G, 5H, 5I and 5J illustrate a method of manufacturing a structure in which an ejection orifice member and a flow path substrate are integrated according to a fifth embodiment of the present invention.
Figure 5B:
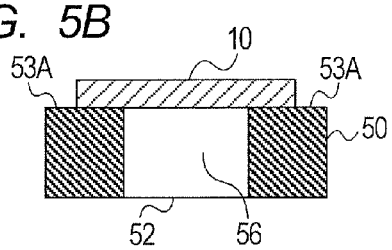
Figure 5C:
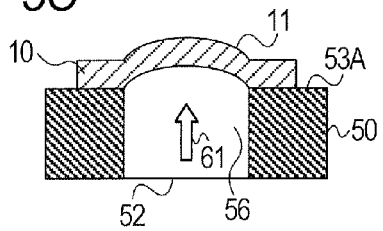
Figure 5D:
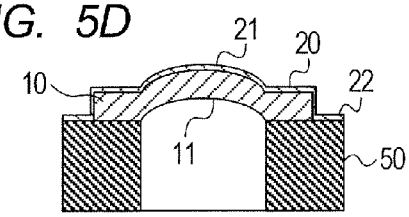
Figure 5E:
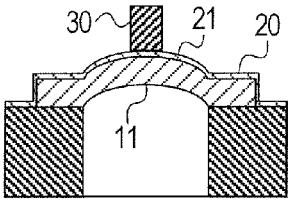
Figure 5F:
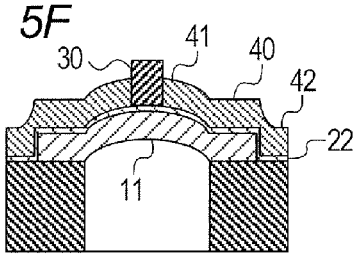
Figure 5G:
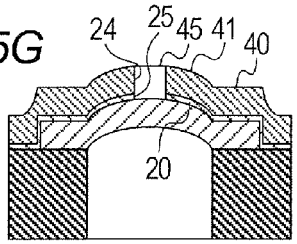
Figure 5H:
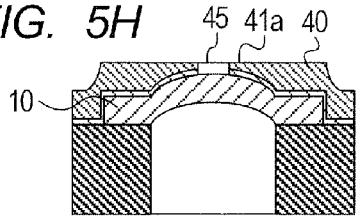
Figure 5I:
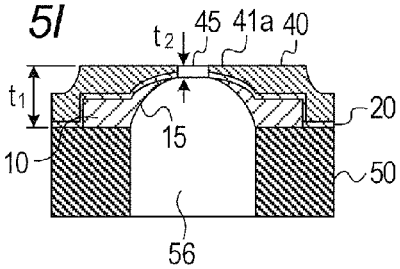
Figure 5J:
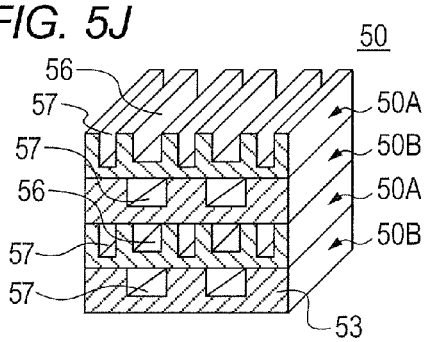

FIG. 5A to FIG. 5J illustrate a method of manufacturing a structure in which an ejection orifice member and a flow path substrate are integrated according to a fifth embodiment of the present invention. In these figures, a manufacturing method is illustrated in which a through hole in the flow path substrate is used to directly form, on the flow path substrate, the ejection orifice member having an ejection orifice that includes the tapered portion and the straight portion. FIG. 5A to FIG. 5I are sectional views illustrating a manufacturing step of the structure in which the ejection orifice member and the flow path substrate are integrated, and FIG. 5J is a perspective view of an example of the flow path substrate. It is to be noted that the term "flow path substrate" as herein employed means a substrate having a flow path formed therein for supplying liquid to the ejection orifice of the ejection orifice member.

First, as illustrated in FIG. 5A, a flow path substrate 50 having a flow path (through hole) 56 formed therein is prepared. A material and a shape of the substrate 50 are determined in accordance with design of the entire inkjet head as a liquid droplet ejection head.

As an example, as illustrated in the perspective view of FIG. 5J, the flow path substrate 50 includes the one or plurality of flow paths 56 extending in one direction, and a plurality of air chambers 57 placed so as to surround the respective flow paths 56 and extending along the flow paths 56. The flow path substrate 50 is formed of a piezoelectric substance (for example, PZT). In particular, in this embodiment, a plurality of substrates 50A each having grooves to be the flow paths 56 and grooves to be the air chambers 57 alternately arranged in an upper surface thereof, and a plurality of substrates 50B each having only grooves to be the air chambers 57 arranged in an upper surface thereof are prepared. The substrates 50A and the substrates 50B are alternately laminated under a state in which a lower surface of each of the substrates 50A is bonded onto the upper surface of each of the substrates 50B to form the flow path substrate 50.

The grooves 56 to be the flow paths and the grooves 57 to be the air chambers are formed by dicing. It is to be noted that the grooves for the air chambers 57 in the substrate 50B are formed at places corresponding to the grooves for the flow paths 56 in the substrate 50A, respectively, when the substrate 50A and the substrate 50B are joined to each other. Electrodes for driving (not shown) are formed on inner walls and outer walls of the grooves, respectively. Such an inkjet head is referred to as a piezoelectric drive inkjet head, and is driven in a shear mode or in a gould mode.

With reference to FIG. 5A and FIG. 5J, the first opening 51 of the flow path 56 illustrated in FIG. 5A is in the principal surface 53 of the substrate 50 illustrated in FIG. 5J, while the second opening 52 is in a surface opposite to the principal surface 53. It is preferred that the first opening 51 be formed in the shape of a square with a side of 150 μm.

It is to be noted that the flow path substrate 50 formed of a piezoelectric substance of this embodiment can give, by distorting and deforming the flow paths 56 and increasing or decreasing the volume of the flow path 56 through voltage application to the electrode for driving (not shown), ejection pressure to liquid (for example, ink) supplied through the flow path 56 to the principal surface 53 side. However, ejection energy given to the liquid is not limited to such pressure by the piezoelectric substance, and thus, the flow path substrate 50 may be substituted by other embodiments which are different from this embodiment.

After the flow path substrate 50 is prepared as described above, as illustrated in FIG. 5B, the first layer 10 is formed on the principal surface 53 of the flow path substrate 50 so as to cover the first opening 51. The first layer 10 is formed of a film-like photoresist which is laminated to the principal surface 53 of the flow path substrate 50. The photoresist is an SU-8 film, and it is preferred that the thickness be, for example, 30 μm. In this step, the SU-8 film is patterned by photolithography to expose a surface 53A of the principal surface 53 of the flow path substrate 50. At this time, the entire surface of the patterned SU-8 film is exposed.

Then, as illustrated in FIG. 5C, the protruding portion 11 is formed in the first layer 10 under a state in which the portion of the first layer 10 (SU-8 film) which covers the first opening 51 protrudes in the first direction 62. In this case, first, compressed air is fed from the second opening 52 of the flow path (through hole) 56 into space which is a blind hole formed by a side wall of the flow path 56 and the first layer 10 (see the direction denoted as 61), and the pressure forms the shape of the protruding portion 11. With the state being maintained, the first layer 10 formed of the SU-8 film is heated up to about 180° C. and cured to fix the protruding shape of the protruding portion 11. Pressure of air which is fed into the space as the blind hole is adjusted as necessary during the heating so that the protruding portion 11 may be formed into a desired shape in the end. As an example of the desired shape of the protruding portion 11, the protruding portion 11 has a shape of a spherical crown, and it is preferred that a radius of curvature at the top thereof be 150 μm.

Then, as illustrated in FIG. 5D, a Cr film of 10 nm and a Pd film of 40 nm are deposited in this order by sputtering on the upper surface of the first layer 10 (SU-8 film) and on the exposed portion 53A of the principal surface of the flow path substrate 50 to form the second layer 20.

Then, as illustrated in FIG. 5E, the third layer 30 is formed on the upper surface of the second layer 20. The third layer 30 is a pattern for defining the straight portion of the ejection orifice. The pattern of the third layer 30 is formed so that the center thereof may approximately match with the center of the protruding portion 11, and the shape and dimensions thereof are designed in accordance with the shape and dimensions of the ejection orifice. As an example, the third layer 30 is formed of a pattern of a cylindrical positive photoresist, and it is preferred that the diameter be 10 μm and the thickness be 30 μm.

Then, as illustrated in FIG. 5F, plating is performed with the second layer 20 being used as a seed to form the fourth layer 40 on the surface of the second layer 20. As an example, the fourth layer 40 is formed of Ni which is formed by electroless plating on the second layer 20, and it is preferred that the thickness be 25 μm. In this step, the protruding portion 41 is formed in the fourth layer 40 so as to follow the contour of the curved surface of the protruding portion 21 of the second layer 20.

Then, as illustrated in FIG. 5G, the third layer is removed to form the hole 24 to be the straight portion 45 of the ejection orifice in the fourth layer 40. The straight portion 45 of the ejection orifice is formed at the center of the protruding portion 41. As an example, the third layer 30 is formed of a photoresist and is removed by a resist remover. Further, a portion of the second layer 20 which is exposed in an opening 45 in the fourth layer 40 is removed by argon ion milling with the fourth layer 40 being used as a mask to form the hole 25.

Next, at least the protruding portion 41 in the fourth layer 40 (a portion which is bowed outward and which has the straight portion 45 of the ejection orifice and the hole 24 at the center thereof) is thinned as illustrated in FIG. 5H. The portion denoted as 41*a* is the thinned portion. As an example, the fourth layer 40 is polished from the upper surface thereof so that the thickness of the ejection orifice member around the straight portion 45 of the ejection orifice may be 5 μm. This enables Ni as the fourth layer 40 to have a thickness of 5 μm around the straight portion 45 of the ejection orifice, gradually larger thicknesses from the straight portion 45 of the ejection orifice toward a periphery thereof, and a largest thickness at the flat portion outside the portion 41*a* formed by thinning the protruding portion 41 (about 25 μm).

Then, as illustrated in FIG. 5I, the portion of the first layer 10 exposed in the hole 25 in the second layer 20 is isotropically etched by oxygen plasma with the fourth layer 40 being used as a mask to form the tapered hole 15. In this etching, etching conditions are varied as necessary to adjust the shape of the hole 15. The ejection orifice obtained in this way has a straight shape on the ink ejection side and has a tapered shape on the ink introduction side. Specifically, the straight portion of the ejection orifice is a hole portion formed by removing the third layer 30 from the fourth layer 40 and removing the part of the second layer 20 opposed to the ejection orifice 45, and the tapered portion of the ejection orifice is the hole 15 having a tapered shape formed in the first layer 10. The ejection orifice member formed in this way has the smallest thickness at the ejection orifice 45 (thickness=$t_2$), gradually larger thicknesses from the ejection orifice 45 toward a periphery thereof, and the largest thickness at the flat portion outside the portion 41*a* formed by thinning the protruding portion 41 (thickness=$t_1$). Exemplary thicknesses include $t_1$=65 μm and $t_2$=5 μm. It is to be noted that in the ejection orifice member as illustrated in FIG. 5I, the thickness $t_2$ is a thickness which is the total of the thicknesses of the second layer 20 and the fourth layer 40 in the thinned portion 41*a*, and the thickness $t_1$ is a thickness which is the total of the thicknesses of the first layer 10, the second layer 20, and the fourth layer 40.

By the method described above, the ejection orifice member having the ejection orifice which includes the tapered portion and the straight portion is directly formed on the flow path substrate.

According to this embodiment, an ejection orifice member having a smallest thickness at the ejection orifice 45 and a sufficient thickness at portions away from the ejection orifice 45 toward a periphery thereof can be manufactured with ease. In such an ejection orifice member, compared with the related art, the fluid resistance through the ejection orifice is reduced, and at the same time, the strength of the ejection orifice member as a whole is secured. Further, an opened edge of the straight portion 45 of the ejection orifice is not burred in the ejection direction, and a surface of the ejection orifice member in which the ejection orifice opens is flat. Thus, a wiping unit configured to wipe and clean the surface is less liable to be damaged.

Further, in a liquid ejection head such as an inkjet head having the ejection orifice member, the fluid resistance through the ejection orifice is low, and thus, even a high-viscosity liquid such as ink may be ejected with a relatively small drive force (liquid ejection force). Further, the ejection orifice member is directly formed on the flow path substrate, and thus, compared with a liquid ejection head obtained by joining together an ejection orifice member and a flow path substrate with an adhesive, durability of the liquid ejection head is improved.

Embodiments of the present invention are described above with reference to the attached drawings, but the present invention is not limited to the illustrated structures and shapes, and the above embodiments may be modified or combined as appropriate within the technical idea of the present invention.

According to the present invention, the ejection orifice member having the ejection orifice with reduced fluid resistance compared with the related art can be manufactured easily without sacrificing the strength as a whole. Further, the liquid droplet ejection head including the ejection orifice member with low fluid resistance can be manufactured easily.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-179129, filed Aug. 30, 2013, which is hereby incorporated by reference herein in its entirety.

What is claimed is:

1. A method of manufacturing an ejection orifice member comprising an ejection orifice for ejecting liquid, the method comprising:

preparing a substrate comprising a first layer, a second layer, and a third layer, the first layer protruding in a direction crossing a principal surface of the substrate, the second layer and the third layer being formed on the first layer, wherein the preparing of the substrate comprises:

forming the second layer so as to follow a contour of a surface of the first layer; and then forming the third layer on a surface of the second layer which protrudes;

performing plating with the second layer being used as a seed to form a fourth layer on the second layer;

removing the third layer from the fourth layer to form a hole to be the ejection orifice in the fourth layer; and thinning the fourth layer at least around the hole.

2. The method according to claim 1, wherein the first layer comprises a flexible film.

3. The method according to claim 1, wherein the first layer comprises one of a thermosetting resin and a photosetting resin.

4. The method according to claim 1, further comprising curing at least a protruding portion of the first layer to fix a shape of the protruding portion.

5. A method of manufacturing an ejection orifice member on a principal surface of a flow path substrate, the ejection orifice member comprising an ejection orifice for ejecting liquid, the method comprising:

preparing the flow path substrate having a first opening of a flow path provided in the principal surface thereof;

forming a first layer on the principal surface so as to cover the first opening;

causing a portion of the first layer which covers the first opening to protrude in a direction crossing the principal surface;

forming a second layer so as to follow a contour of a surface of the first layer and then forming a third layer on a surface of the second layer which protrudes;

performing plating with the second layer being used as a seed to form a fourth layer on the second layer;

removing the third layer from the fourth layer to form a hole to be the ejection orifice in the fourth layer;

thinning the fourth layer at least around the hole; and removing a part of the second layer and a part of the first layer which correspond to the ejection orifice so that the ejection orifice and the flow path communicate to each other.

6. The method according to claim 5, further comprising pressurizing the first layer via a second opening of the flow path located on a side opposite to the first opening to form a protruding portion of the first layer.

* * * * *